US006589142B2

(12) United States Patent
McAfee, Jr.

(10) Patent No.: US 6,589,142 B2
(45) Date of Patent: Jul. 8, 2003

(54) EXERCISE APPARATUS HAVING A SLIDING CARRIAGE

(76) Inventor: Joseph P McAfee, Jr., 4383 Swamp Rd., Doylestown, PA (US) 18901

( * ) Notice: Subject to any disclaimer, the term of this patent is extended or adjusted under 35 U.S.C. 154(b) by 58 days.

(21) Appl. No.: 09/923,313

(22) Filed: Aug. 7, 2001

(65) Prior Publication Data

US 2003/0032534 A1 Feb. 13, 2003

(51) Int. Cl.[7] ..... A63B 26/00
(52) U.S. Cl. ..... 482/133; 482/135; 482/79
(58) Field of Search ..... 482/10, 51, 54, 482/94, 121–124, 129, 130, 133, 132, 134, 148, 79, 135

(56) References Cited

U.S. PATENT DOCUMENTS

| | | | | |
|---|---|---|---|---|
| 4,696,470 A | | 9/1987 | Fenner | |
| 5,066,005 A | | 11/1991 | Luecke | |
| 5,316,535 A | * | 5/1994 | Bradbury | 482/135 |
| 5,338,278 A | | 8/1994 | Endelman | 482/142 |
| 5,607,381 A | | 3/1997 | Endelman | 482/142 |
| 5,653,670 A | | 8/1997 | Endelman | 482/142 |
| 5,938,576 A | | 8/1999 | Minor | 482/142 |
| 6,042,523 A | * | 3/2000 | Grahm | 482/121 |
| 6,120,425 A | | 9/2000 | Endelman | 482/142 |
| 6,494,816 B1 | * | 12/2002 | Corrado | 482/79 |

* cited by examiner

*Primary Examiner*—Glenn E. Richman
(74) *Attorney, Agent, or Firm*—LaMorte & Associates

(57) ABSTRACT

An exercise apparatus that contains a frame and a carriage that moves back and forth along the length of the frame. The movement of the carriage along the frame is resisted by springs that join the carriage to the frame. Two foot support platforms are provided. The first foot support platform extends upwardly from the top of the carriage. The first foot support platform has an adjustable incline and contains a bar that uniformly extends across the width of the carriage a predetermined distance above the top surface of the carriage. The second foot support platform extends above the frame in front of the carriage. Side railings are also provided on either side of the frame. By providing both the unique structure of the first and second foot support platforms and the side railings, a person can not only lie on the moving carriage, but also can stand and kneel between the frame and the moving carriage. As such, a larger variety and diversity of exercises can be performed.

19 Claims, 6 Drawing Sheets

EXERCISE APPARATUS HAVING A SLIDING CARRIAGE

BACKGROUND OF THE INVENTION

1. Field of the Invention

The present invention relates to exercise devices that have a rigid frame and a sliding carriage that moves laterally along the length of the frame. More particularly, the present invention relates to exercise devices having a flat carriage that moves laterally across a frame, wherein the movement of the carriage is resisted by a variable number of springs.

2. Prior Art Statement

In the prior art, there are many different exercise machines that utilize a sliding carriage that moves back and forth laterally along the length of a frame. Many of these exercise machines contain resistance springs that are used to resist the movement of the sliding carriage. Such prior art exercise machines are exemplified by U.S. Pat. No. 5,607,381 to Endelman, entitled Exercise Apparatus; U.S. Pat. No. 5,066,005 to Luecke, entitled Enhanced Core Movement Training Bench; and U.S. Design Pat. No. 362,700 to Breibart, entitled Physical Exerciser. In each of these exercise machines, the sliding carriage is used to support the torso of a person's body lying in either the prone or prostrate position. The platform is then moved against the bias of the resistance spring with that person's legs or the arms.

Since most of the exercise machines in the prior art that use sliding carriages are designed to support a person who is lying on the platform, the platforms are most commonly designed with a head support and shoulder supports. Typically, the head support is a small padded inclined surface that supports the head. The shoulder supports are usually vertical elements on either side of the head support that engage the tops of the shoulders when a person is lying on the top of the sliding carriage. The head support, shoulder supports and top surface of the carriage are all heavily padded for a person's comfort. The head support and shoulder supports prevent a person from moving across the top of the carriage during an exercise routine.

As a person is lying on the sliding carriage, that person's feet typically engage a foot support that is part of the static frame. Thus, when a person pushes against the foot support, the sliding carriage can be made to move along the static frame.

In most prior art designs, the location of the foot support, the head support and the shoulder support are fixed and have little adjustability. Although these elements are necessary to use the exercise machine by a person lying in a prone position, these same elements prevent the exercise machine from comfortably being used by a person in a standing position. A need therefore exists in the art for a more versatile exercise machine that has adjustable elements that enable the sliding platform to be used by people to perform exercises in multiple standing positions, prone positions and in between positions. This need is met by the present invention as it is described and claimed below.

SUMMARY OF THE INVENTION

The present invention is an exercise apparatus that contains a frame and a carriage that moves back and forth along the length of the frame. The movement of the carriage along the frame is resisted by springs that join the carriage to the frame. Two foot support platforms are provided. The first foot support platform extends upwardly from the top of the carriage. The first foot support platform has an adjustable incline and contains a bar that uniformly extends across the width of the carriage a predetermined distance above the top surface of the carriage. The second foot support platform extends above the frame in front of the carriage. Side railings are also provided on either side of the frame.

By providing both the unique structure of the first and second foot support platforms and the side railings, a person can not only lie on the moving carriage, but also can stand and kneel between the frame and the moving carriage. As such, a larger variety and diversity of exercises can be performed.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
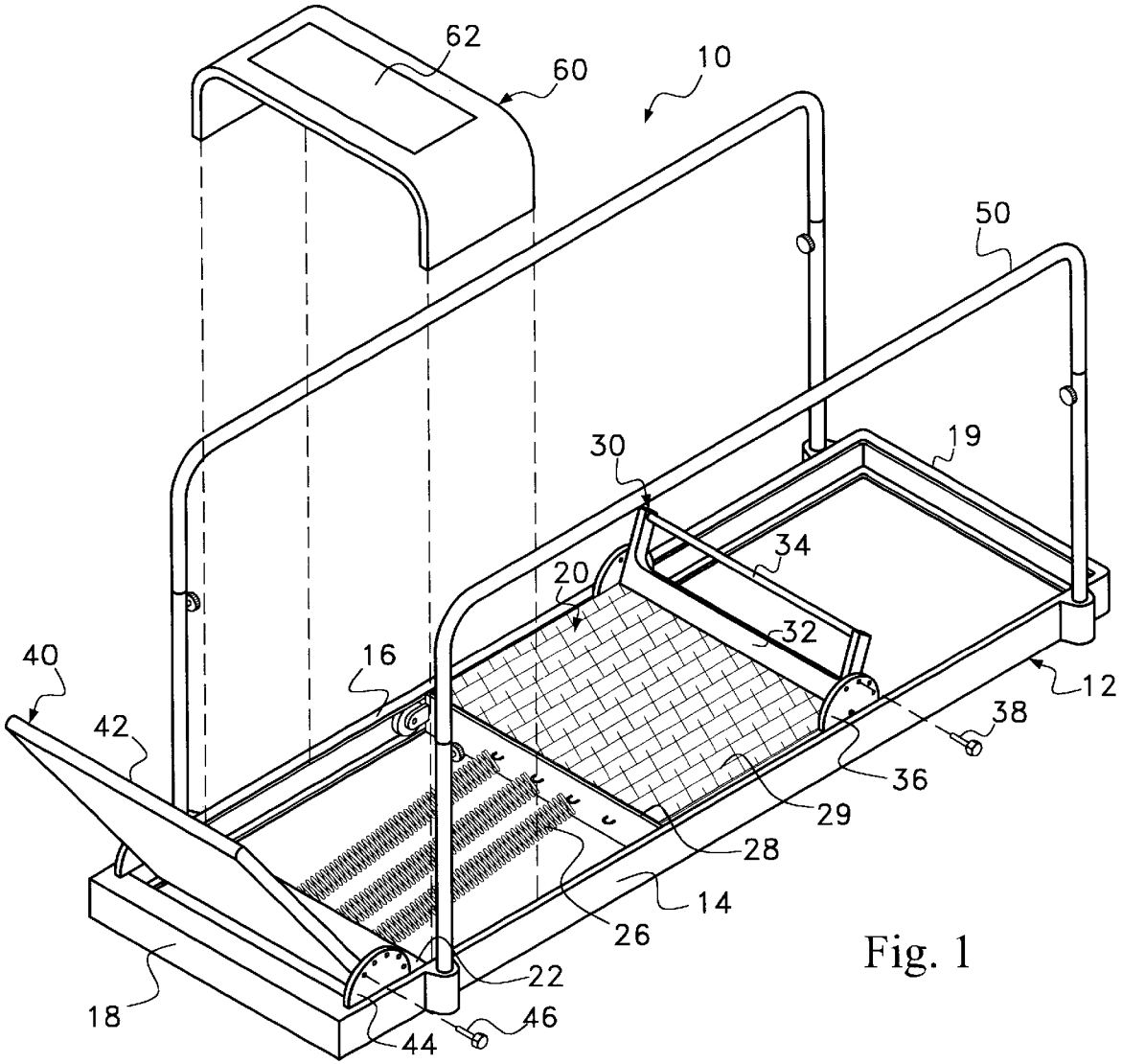
FIG. 1 is a perspective view of an exemplary embodiment of an exercise device in accordance with the present invention.

Referring to FIG. 1, an exemplary embodiment of the present invention exercise device 10 is shown. The exercise device 10 has a frame 12, on which is disposed a sliding carriage 20. The frame 12 is rectangular in shape, having two parallel long rails 14, 16 and two parallel short rails 18, 19. The long rails 14, 16 and the short rails 18, 19 rest directly on the ground. Accordingly, the frame 12 is as low to the ground as is possible. The sliding carriage 20 rests within the frame 12. As will later be explained, the sliding carriage 20 contains wheels that enable the sliding carriage 20 to move back and forth within the frame 12 along the length of the long rails 14, 16 of the frame 12.

A mounting plate 22 is anchored to one of the short rails 18 of the frame 12. On the mounting plate 22 are attachment mounts 24 for a plurality of resistance springs 26. A similar mounting plate is also coupled to the sliding carriage 20. A plurality of resistance springs 26 are provided. Any number of resistance springs 26 can be mounted between the sliding carriage 20 and the mounting plate 22 on the frame 12. The springs 26 provide resistance to the movement of the sliding carriage down the length of the frame 12. The more resistance springs 26 that are attached, the more resistance to the movement of the sliding carriage 20 is provided.

Unlike many prior art exercise devices, the top surface 28 of the sliding carriage 20 is designed to be stepped upon, not laid upon. As such, the top surface 28 of the sliding carriage 20 is not heavily padded. Rather, the top surface 28 of the sliding carriage 20 is rigid and contains a non-slip surface, such as a hard, thin rubber matting 29.

At the far end of the sliding carriage 20 is located an inclined foot support platform 30. The inclined foot support platform 30 has a length that is at least as great as the width of the top surface 28 of the sliding carriage 20. As such, the inclined foot support platform 30 uniformly extends across the width of the top surface 28 of the sliding carriage 20. The inclined foot support platform 30 contains a lower support bar 32 and a upper support bar 34. A gap exists between the lower support bar 32 and the upper support bar 34 that is between one inch and four inches wide. As such, it will be understood that when a person places his/her foot against the foot support platform 30, the heel section of that person's foot will rest against the lower support bar 32 and the toe or ball section of that person's foot will rest against the upper support bar 34.

Preferably the upper support bar 34 presents a flat surface against a user's foot. However, the upper support bar 34 is preferably a round bar that is supported in an orientation that is parallel to the short rails 18, 19 of the frame 12. The rounded shape of the upper support bar 34 and the presence of the gap below the upper support bar 34, enable the upper support bar 34 to be comfortably grasped by a person's hands, as will later be explained.

The inclined foot support platform 30 extends at an angle from the top surface 28 of the sliding carriage 20. The inclined foot support platform 30 is supported by two brackets 36. Apertures are formed in each bracket 36 at various points. A locking pin 38 extends through the bracket 36 and into the foot support platform 30. By adjusting which aperture the locking pin 38 engages, the angle of the foot support platform 30 can be selectively altered. The range of angles preferably extends from ninety degrees down to thirty degrees, relative the top surface 28 of the sliding carriage 20.

A second foot support platform 40 extends upwardly from the frame 12 of the exercise device 10 in front of the sliding carriage 20. The second foot support platform 40 is not part of the sliding carriage 20. The second foot support platform 40 has a flat planar face surface 42 that faces the sliding carriage 20 at an obtuse angle. The angle of the second foot support platform 40 relative the top surface 28 of the sliding platform 40 is also adjustable. Brackets 44 are located at the base of the second foot support platform 40. Apertures are formed in the brackets 44 at various heights. By placing a locking pin 46 through the different apertures in the brackets 44, the angle of the second foot support platform 40 can be selectively changed.

As will later be explained, the present invention exercise device 10 is specifically designed to support people in various standing, kneeling and crouching positions. To help in this manner, two support railings 50 are provided on either side of the frame 12. The support railings 50 help a person standing on the exercise device 10 to maintain their balance as they perform exercises from an upright position. The railings extend above the sliding carriage 20 by two to four feet. The railings 50 can be adjustable in height to accommodate people of differing statures.

In FIG. 1, an optional bridge platform 60 is also shown. The bridge platform 60 extends over a section of the frame 12 and is self-supporting on the ground. The bridge platform 60 has a flat top surface 62 and is used when performing exercises from a kneeling position, as will later be explained.

Figure 2:
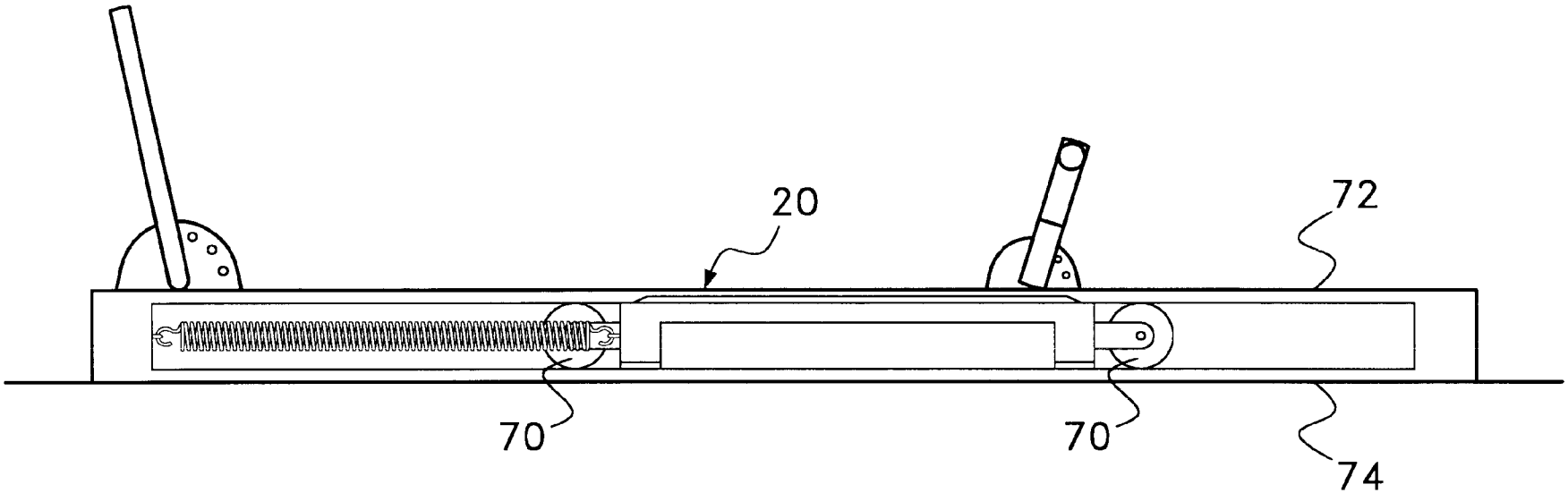
FIG. 2 is a selectively cross-sectioned view of an exercise device shown in FIG. 1.

Referring to FIG. 2, it can be seen that the sliding carriage 20 rolls on wheels 70. The long rails 16 of the frame 12 have a top ledge 72 and a bottom ledge 74. The wheels 70 of the sliding carriage 20 engage both the top ledge 72 and the bottom ledge 74 so that the sliding carriage 20 cannot be moved in any direction other than along the length of the frame 12.

Figure 3:
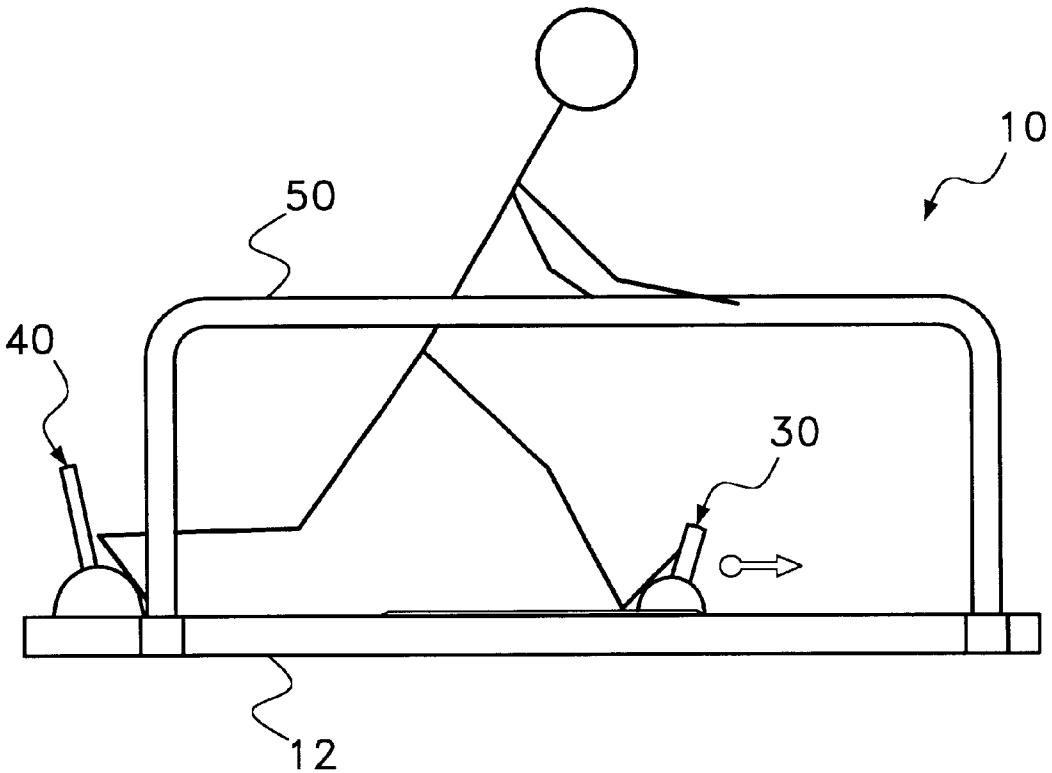
FIG. 3 is a side view of the exercise device shown in FIG. 1 shown in use for a first type of exercise.

Referring to FIG. 3, it can be seen that a person can exercise using the present invention exercise device 10 by placing one foot on the first foot support platform 30 on the sliding carriage and one foot on the second foot support platform 40 on the frame 12. A person facing forward can then stretch and exercise the lliotibial tract, biceps femoris, semitendinosus, and other muscles in the group commonly referred to as the hamstring muscles. Since the person using the exercise device is standing, balance is maintained using the side railings 50.

Figure 4:
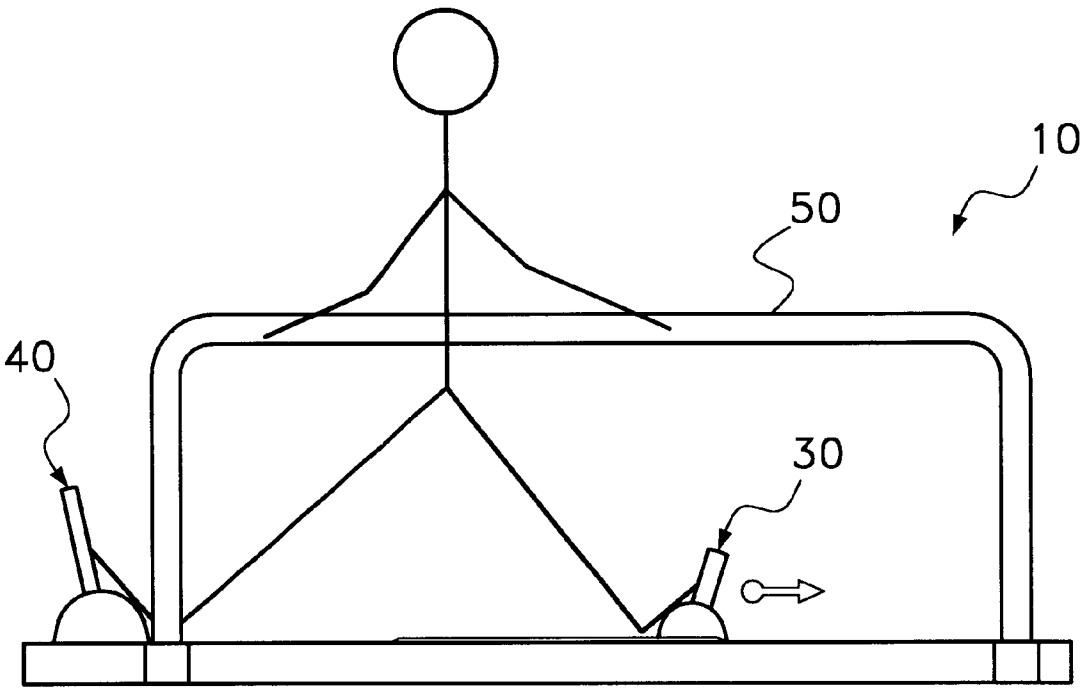
FIG. 4 is a side view of the exercise device shown in FIG. 1 shown in use for a second type of exercise.

Referring to FIG. 4, it can be seen that by a person turning ninety degrees from the orientation in FIG. 3, a person is now facing one of the side railings 50. By placing one foot on the first foot support platform 30 and one foot on the second foot support platform 40, a person can then stretch and exercise the leg adductor muscle groups. Again, since the person is standing in the exercise device 10, balance is maintained by using the side railings 50.

Figure 5:
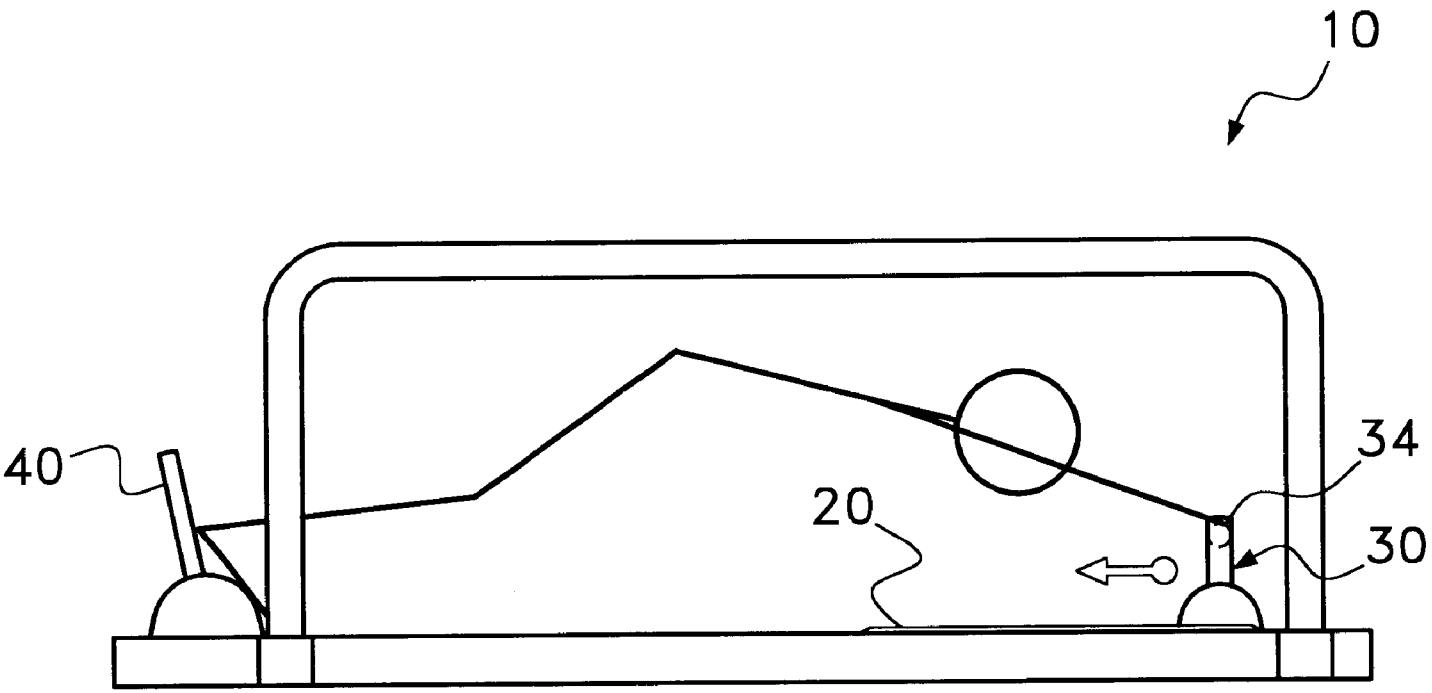
FIG. 5 is a side view of the exercise device shown in FIG. 1 shown in use for a third type of exercise.

Referring to FIG. 5, it can be seen that the use of the bar 34 at the top of the first foot support platform 30 enables the first foot support platform 30 to be grasped by a person's hands. In FIG. 5, it can be seen that the exercise device 10 enables a person to grab the bar 34 on the first foot support platform 30 and rest his/her feet against the second foot support platform 40. As the sliding carriage 20 is moved back and forth, the exercise device 10 works the muscle groups in the abdomen and back.

Figure 6:
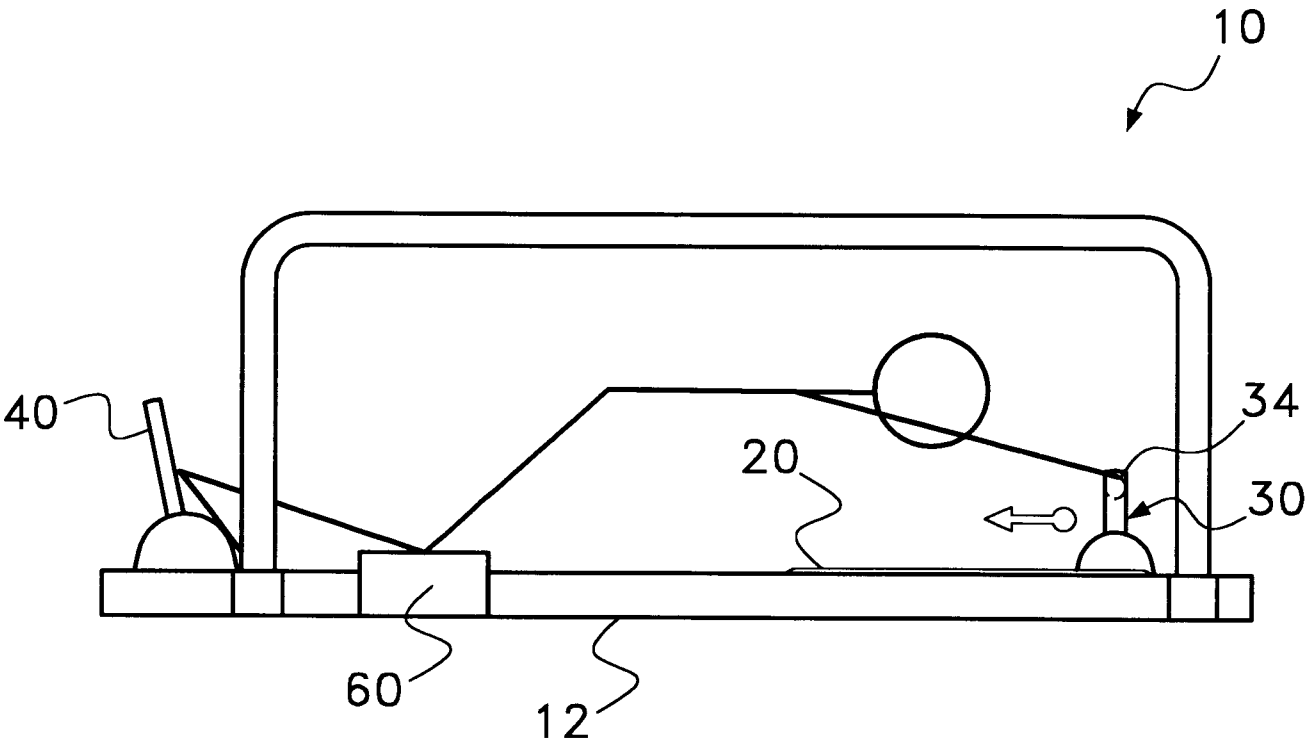
FIG. 6 is a side view of the exercise device shown in FIG. 1 utilizing the bridge platform to perform a fourth type of exercise.

Referring to FIG. 6, it can be seen that the bridge platform 60 is placed over the frame 12. The bridge platform 60 provides a static support for the knees so that a person can kneel over the exercise device 10. Once kneeling on the bridge platform 60, a person can grab the bar 34 on the first foot support platform 30. By moving the sliding carriage 20 back and forth, a person can exercise muscles in the upper back and abdomen.

FIGS. 3–6 show only a few of the many exercises that can be performed on the exercise device. Many other exercises and stretching activities can be performed other than what is shown. However, by providing both an adjustable inclined foot support 30 on the sliding carriage 20 and side railings 50, standing exercises can be performed on the present invention exercise device that cannot be performed on other pieces of exercise equipment.

It will be understood that the embodiments of the present invention described and illustrated are merely exemplary and a person skilled in the art can make many variations to the shown embodiments. For example, there are many known ways to adjust the angle of an inclined plane. Any such known adjustment mechanism can be adapted for use to adjust the angle of the first and second foot support platforms. All such alternate embodiments and modifications are intended to be included within the scope of the present invention as defined below in the claims.

What is claimed is:

1. An exercise device, comprising:

a frame having a first end, a second end and two parallel rail elements extending therebetween, wherein said rail elements are spaced a predetermined distance apart along their length;

a movable carriage disposed between said parallel rail elements, said carriage having a flat top surface and a width that spans said predetermined distance between said parallel rail elements, wherein said carriage is movable along said length of said rail elements;

a first foot support platform extending upwardly from said carriage at an adjustable angle, said first foot support platform including a bar that is supported across the width of said platform at an orientation perpendicular to said parallel rail elements; and a second foot support platform extending upwardly from said frame at an adjustable angle, said second foot support platform having a flat face surface that extends across said parallel rail elements proximate said first end of said frame.

2. The device according to claim 1, further including a set of railings supported a predetermined height above said frame, wherein said railings are parallel to said rail elements of said frame.

3. The device according to claim 2, wherein said predetermined height of said railings is selectively adjustable.

4. The device according to claim 1, further including a bridge platform that can be selectively placed over said frame, wherein said bridge platform has a flat top surface that spans across said parallel rail elements.

5. The device according to claim 1, further including resistance elements that bias said carriage toward said first end of said frame.

6. The device according to claim 1, wherein said first foot support platform is a generally rectangular structure that extends across the width of said carriage, said first foot support platform having a lower bar element and an upper bar element, wherein said lower bar element and said upper bar element are parallel and a gap exists between said lower bar element and said upper bar element.

7. The device according to claim 1, wherein said top surface of said carriage is rigid and has a non-slip covering thereon.

8. An exercise apparatus, comprising:

a frame having a first end and a second end;

a mobile carriage, of a predetermined width, that is supported by said frame, wherein said mobile carriage is capable of reciprocally moving between said first end and said second end of said frame;

a first foot support platform extending upwardly from said carriage, wherein said first foot support platform extends uniformly across said width of said carriage and supports a bar a predetermined height above said carriage;

a second foot support platform extending upwardly from said frame proximate said first end;

at least one spring for biasing said carriage toward said first end of said frame.

9. The apparatus according to claim 8, wherein said carriage has a flat, hard top surface on which is disposed a non-slip material.

10. The apparatus according to claim 8, further including a set of railings supported a predetermined height above said frame, wherein said railings are parallel.

11. The apparatus according to claim 10, wherein said predetermined height of said railing is selectively adjustable.

12. The apparatus according to claim 8, further including a bridge platform that can be selectively placed over said frame, wherein said bridge platform has a flat top surface that spans across said frame.

13. The apparatus according to claim 8, wherein said first foot support platform extends above said carriage at an angle and said apparatus further includes a mechanism for selectively adjusting said angle.

14. The apparatus according to claim 8, wherein said second foot support platform extends above said frame at an angle and said apparatus further includes a mechanism for selectively adjusting said angle.

15. An exercise apparatus, comprising:

a frame having a first end and a second end;

a first foot support platform coupled to said frame proximate said first end, said first foot support platform having an inclined face surface against which a person's foot can be placed;

a movable carriage supported by said frame, wherein said carriage has a predetermined width and is movable along said frame between said first and said second end;

a second foot support platform extending upwardly from said carriage wherein said second foot support platform uniformly extends across said width of said carriage and contains a bar that is supported only at its ends above said carriage.

16. The apparatus according to claim 15, wherein said first foot support platform extends above said frame at an angle and said apparatus further includes a mechanism for selectively adjusting said angle.

17. The apparatus according to claim 15, wherein said second foot support platform extends above said carriage at an angle and said apparatus further includes a mechanism for selectively adjusting said angle.

18. The apparatus according to claim 15, wherein said carriage has a flat, hard top surface on which is disposed a non-slip material.

19. The apparatus according to claim 15, further including a set of railings supported a predetermined height above said frame, wherein said railings are parallel.

* * * * *